US008951371B2

(12) United States Patent
Mihara et al.

(10) Patent No.: US 8,951,371 B2
(45) Date of Patent: Feb. 10, 2015

(54) COPPER ALLOY

(75) Inventors: Kuniteru Mihara, Tokyo (JP); Tatsuhiko Eguchi, Tokyo (JP); Nobuyuki Tanaka, Tokyo (JP); Kiyoshige Hirose, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 1085 days.

(21) Appl. No.: 12/976,409

(22) Filed: Dec. 22, 2010

(65) Prior Publication Data

US 2011/0094635 A1 Apr. 28, 2011

Related U.S. Application Data

(62) Division of application No. 11/066,323, filed on Feb. 25, 2005, now abandoned.

(30) Foreign Application Priority Data

Feb. 27, 2004 (JP) ..... 2004-054905
Nov. 11, 2004 (JP) ..... 2004-328249

(51) Int. Cl.
*C22C 9/06* (2006.01)
*C22F 1/08* (2006.01)

(52) U.S. Cl.
CPC ..... *C22C 9/06* (2013.01)
USPC ..... 148/554; 148/414; 420/469; 420/485

(58) Field of Classification Search
CPC ..... C22C 9/06; C22C 9/10
USPC ..... 420/469, 485; 148/414, 554
See application file for complete search history.

(56) References Cited

U.S. PATENT DOCUMENTS

| | | | | |
|---|---|---|---|---|
| 2,851,353 | A | 9/1958 | Roach et al. | |
| 4,792,365 | A * | 12/1988 | Matsui et al. | 148/554 |
| 4,818,307 | A | 4/1989 | Mori et al. | |
| 2002/0119071 | A1 * | 8/2002 | Usami et al. | 420/476 |

FOREIGN PATENT DOCUMENTS

| | | | |
|---|---|---|---|
| JP | 59-145745 | A | 8/1984 |
| JP | 63-042360 | A | 2/1988 |
| JP | 63-109134 | A | 5/1988 |
| JP | 63-143230 | A | 6/1988 |
| JP | 63-149345 | A | 6/1988 |
| JP | 63-241131 | A | 10/1988 |
| JP | 63-262448 | A | 10/1988 |
| JP | 63-266033 | A | 11/1988 |
| JP | 2-122039 | A | 5/1990 |
| JP | 2170937 | A | 7/1990 |
| JP | 04-180531 | A | 6/1992 |
| JP | 06-184680 | A | 7/1994 |
| JP | 7-018356 | A | 1/1995 |
| JP | 2714560 | A | 2/1998 |
| JP | 10-152737 | A | 6/1998 |
| JP | 10-219374 | A | 8/1998 |
| JP | 11-043731 | A | 2/1999 |
| JP | 2002-097534 | A | 4/2002 |
| JP | 2003-082425 | A | 3/2003 |

OTHER PUBLICATIONS

Japanese Notice of Reasons for Rejection dated Feb. 27, 2007, issued in corresponding Japanese Patent Application No. 2005-054388, with English Translation.

International Search Report of PCT/JP2005/003675, mailing date Jun. 14, 2005.

German Office Action dated Feb. 27, 2008, issued in corresponding German Application No. 11 2005 000 312.4.

* cited by examiner

*Primary Examiner* — Kevin P. Kerns

(74) *Attorney, Agent, or Firm* — Westerman, Hattori, Daniels & Adrain, LLP

(57) ABSTRACT

A method of producing a copper alloy containing a precipitate X composed of Ni and Si and a precipitate Y that includes (a) Ni and 0% Si, (b) Si and 0% Ni, or (c) neither Ni nor Si, wherein the precipitate X has a grain size of 0.001 to 0.1 μm, and the precipitate Y has a grain size of 0.01 to 1 μm.

27 Claims, No Drawings

COPPER ALLOY

CROSS-REFERENCE TO RELATED APPLICATIONS

This application is a divisional application of U.S. application Ser. No. 11/066,323, filed on Feb. 25, 2005, now abandoned, which is based on and claims priority from Japanese Patent App. No. 2004-328249, filed on Nov. 11, 2004 and Japanese Patent Application No. 2004-54905, filed on Feb. 27, 2004, the entire contents of each being incorporated herein by reference.

TECHNICAL FIELD

The present invention relates to a method for preparing an improved copper alloy.

BACKGROUND ART

Heretofore, generally, in addition to iron-based materials, copper-based materials such as phosphor bronze, red brass, and brass, which are excellent in electrical conductivity and thermal conductivity, have been used widely as materials for parts of electric and electronic machinery and tools (electrical and electronic instruments).

Recently, demands for miniaturization, weight saving, and associated high-density packaging of parts of electric and electronic machinery and tools have increased, and various characteristics are required for the copper-based materials applied thereto. Examples of basic characteristics required include mechanical properties, electrical conductivity, stress relaxation resistance, and bending property. Of those, improvements in tensile strength and bending property are strongly required, for satisfying the recent demands for the miniaturization of parts or components for the products described above.

The requirements depend on shapes or the like of the parts, and specific requirements include: a tensile strength of 720 MPa or more and a bending property of $R/t \leq 1$ (in which R represents a bending radius, and t represents a thickness); a tensile strength of 800 MPa or more and a bending property of $R/t<1.5$; or a tensile strength of 900 MPa or more and a bending property of $R/t<2$. The required characteristics have reached a level that cannot be satisfied with conventional commercially available, mass-produced alloys such as phosphor bronze, red brass, and brass. Such alloys each have an increased strength by: allowing Sn or Zn having a very different atomic radius from that of copper as a matrix phase, to be contained as a solid solution in Cu; and subjecting the resultant alloy having the solid solution to cold working such as rolling or drawing. The method can provide high-strength materials, by employing a large cold working ratio, but employment of a large cold working ratio (generally 50% or more) is known to conspicuously degrade bending property of the resultant alloy material. The method generally involves a combination of solid solution strengthening and working strengthening.

An alternative strengthening method is a precipitation strengthening method that involves formation of a precipitate of a nanometer order in the materials. The precipitation strengthening method has merits of increasing strength and improving electrical conductivity at the same time, and is used for many alloys.

Of those, a strengthened alloy prepared by forming a precipitate composed of Ni and Si by adding Ni and Si into Cu, so-called a Corson alloy, has a remarkably high strengthening ability compared with many other precipitation-type alloys (precipitation hardened alloys). This strengthening method is also used for some commercially available alloys (e.g. CDA70250, a registered alloy of Copper Development Association (CDA)). When the alloy generally subjected to precipitating strengthening is used for terminal/connector materials, the alloy is produced through a production process incorporating the following two important heat treatments. A first heat treatment involves heat treatment at a high temperature (generally 700° C. or higher) near a melting point, so-called solution treatment, to allow Ni and Si precipitated through casting or hot rolling to be contained as a solid solution into a Cu matrix. A second heat treatment involves heat treatment at a lower temperature than that of the solution treatment, so-called aging treatment, to precipitate Ni and Si, which are in the solid solution caused at the high temperature, as a precipitate. The strengthening method utilizes a difference in concentrations of Ni and Si entering Cu as a solid solution at high temperatures and low temperatures, and the method itself is a well-known technique in production of precipitation-type alloys.

An example of the Corson alloy suitable for parts of electric and electronic machinery and tools includes an alloy having a defined crystal grain size.

However, the precipitation-type alloy has such problems that the crystal grain size increases to cause too large crystal grains during the solution treatment, and that the crystal grain size during the solution treatment remains unchanged and becomes the crystal grain size of a product since the aging treatment generally does not involve recrystallization. An increased amount of Ni or Si to be added requires a solution treatment at a higher temperature, and it results in that the crystal grain size tends to increase to cause too large crystal grains, through a heat treatment in a short period of time. Too large crystal grains occurred in this way cause problems of conspicuous deterioration in bending property.

Alternatively, a method of improving the bending property of a copper alloy involves addition of Mn, Ni, and P for a mutual reaction to precipitate a compound, without use of a Ni—Si precipitate.

However, the alloy has a tensile strength of about 640 MPa at most, which is not sufficient for satisfying the recent demands for high strength through miniaturization of parts. Addition of Si to the copper alloy decreases the amount of the Ni—P precipitate, to thereby reduce the mechanical strength and electrical conductivity. Further, excess Si and P cause problems of occurrence of crack during hot working.

The bending property is hardly maintained with increasing tensile strength, and a copper alloy having tensile strength, bending property, and electrical conductivity at high levels has been required.

Other and further features and advantages of the invention will appear more fully from the following description.

DISCLOSURE OF INVENTION

According to the present invention, there is provided the following means:

(1) A copper alloy, comprising:

a precipitate X composed of Ni and Si; and a precipitate Y that comprises Ni or Si or neither Ni nor Si, wherein the precipitate X has a grain size of 0.001 to 0.1 μm, and the precipitate Y has a grain size of 0.01 to 1 μm.

(2) The copper alloy according to the above item (1), wherein the precipitate Y has a melting point higher than a solution treatment temperature.

(3) The copper alloy according to the above item (1) or (2), which comprises Ni 2 to 5 mass %, Si 0.3 to 1.5 mass %, and B 0.005 to 0.1 mass %, with the balance being Cu and unavoidable impurities, wherein the number of grains of the precipitate X per $mm^2$ is 20 to 2,000 times the number of grains of the precipitate Y per $mm^2$.

(4) The copper alloy according to the above item (1) or (2), which comprises Ni 2 to 5 mass %, Si 0.3 to 1.5 mass %, Mn 0.01 to 0.5 mass %, and P 0.01 to 0.5 mass %, with the balance being Cu and unavoidable impurities, wherein the number of grains of the precipitate X per $mm^2$ is 20 to 2,000 times the number of grains of the precipitate Y per $mm^2$.

(5) The copper alloy according to the above item (1) or (2), which comprises Ni 2 to 5 mass %, Si 0.3 to 1.5 mass %, B 0.005 to 0.1 mass %, Mn 0.01 to 0.5 mass %, and P 0.01 to 0.5 mass %, with the balance being Cu and unavoidable impurities, wherein the number of grains of the precipitate X per $mm^2$ is 20 to 2,000 times the number of grains of the precipitate Y per $mm^2$.

(6) The copper alloy according to the above item (1) or (2), wherein the number of grains of the precipitate X is $10^8$ to $10^{12}$ per $mm^2$, and the number of grains of the precipitate Y is $10^4$ to $10^8$ per $mm^2$.

(7) The copper alloy according to any one of the above items (1) to (6), which comprises at least one element selected from the group consisting of Al, As, Hf, Zr, Cr, Ti, C, Fe, P, In, Sb, Mn, Ta, and V in an amount of 0.005 to 0.5 mass %.

(8) The copper alloy according to the above item (6) or (7), wherein the precipitate Y is composed of at least one of Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

(9) The copper alloy according to any one of the above items (3) to (8), which further comprises at least one element selected from the group consisting of Sn 0.1 to 1.0 mass %, Zn 0.1 to 1.0 mass %, and Mg 0.05 to 0.5 mass %.

(10) The copper alloy according to any one of the above items (1) to (9), which is for use in an electric or electronic machinery and tool.

BEST MODE FOR CARRYING OUT THE INVENTION

The present invention is explained in detail below.

The inventors of the present invention have conducted intensive studies on a copper alloy suitably used for electrical and electronic parts, and we have found a relationship among grain sizes of Ni—Si precipitate and other precipitate(s) in a copper alloy structure, a ratio in distribution density thereof, and suppression of growth of too large crystal grains. As a result, the inventors of the present invention have completed the present invention of the copper alloy having excellent tensile strength and favorable bending property.

Preferable embodiments of the copper alloy of the present invention will be described in detail.

The present invention relates to controlling of a crystal grain size of an alloy. To be specific, the inventors of the present invention have conducted experiments for a method of controlling a grain size, from two standpoints, and we have attained a specific alloy structure of the present invention, as well as a preferable composition thereof.

First, the inventors of the present invention have searched for an element that does not allow a crystal grain size to increase during a solution treatment. The inventors of the present invention have found that a precipitate composed of Ni and B does not form any solid solution in a Cu matrix phase even at high temperatures of the solution treatment, and that the precipitate exists in crystal grains of the Cu matrix phase and the precipitate grains, to exhibit an action and effect of suppressing growth of the crystal grains of the matrix. The action and effect is also confirmed for Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr, which have been also tested.

Second, the inventors of the present invention have searched for an element that serves as a nucleus at initial recrystallization during the solution treatment. The inventors of the present invention have found that an intermetallic compound which is a precipitate composed of Mn and P serves as a nucleation site for recrystallization at a solution treatment temperature, and that more crystal grains are formed (nucleation) than that in the case where the precipitate composed of Mn and P is not added. Formation of more crystal grains causes mutual interference of the crystal grains during grain growth, to thereby suppress the grain growth. Such an action and effect of the nucleation site for recrystallization is also confirmed for Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

Further, a remarkable effect is confirmed in simultaneous precipitation of Mn—P and Ni—B, which effect cannot be obtained by mere addition of those in the cases using only one of Mn—P or Ni—B.

It is important that the aforementioned precipitate do not form any solid solution in the Cu matrix even during the solution treatment. That is, the precipitate must have a melting point higher than the solution treatment temperature. The precipitate is not limited to the aforementioned precipitates as long as it has a melting point higher than the solution treatment temperature, and the present invention includes any precipitate(s) other than the aforementioned precipitates. In the present invention, a precipitate having a melting point higher than the solution treatment temperature provides an effect of preventing growth of too large crystal grains during the solution treatment or forming many crystal grains (nucleation) by serving as a nucleation site for recrystallization.

The copper alloy of the present invention is an inexpensive, high-performance copper alloy having excellent bending property and other favorable characteristics, and it is preferable for a variety of electric and electronic machinery and tools including electronic parts, e.g. vehicle terminals/connectors, relays, and switches.

Next, the action and effect of each alloy element and a preferable range of addition amount of the alloy element will be described.

Ni and Si are elements that can be added in a controlled addition ratio of Ni to Si for forming a Ni—Si precipitate for precipitation strengthening, to thereby enhance the mechanical strength of the copper alloy. The amount of Ni to be added is generally 2 to 5 mass %, preferably 2.1 to 4.6 mass %. The Ni amount is more preferably 3.5 to 4.6 mass %, for satisfying a tensile strength of 800 MPa or more and a bending property of $R/t<1.5$, or a tensile strength of 900 MPa or more and a bending property of $R/t<2$. A too small Ni amount provides a small precipitated and hardened amount that results in insufficient mechanical strength, and a too large Ni amount results in a conspicuously low electrical conductivity.

Further, Si is known to provide the largest strengthening effect at about ¼ the Ni addition amount calculated in terms of mass %, and such an amount is preferable. A too much Si addition amount is apt to cause cracking of an ingot during hot working, and thus, taking that into consideration, an upper limit of the Si addition amount is to be determined. The Si addition amount is generally 0.3 to 1.5 mass %, preferably 0.5 to 1.1 mass %, more preferably 0.8 to 1.1 mass %.

B forms a precipitate with Ni added. The effect of B as described above is that B is an element for suppressing increase of the crystal grain size to become too large (giant) during the solution treatment, but B takes no part in the precipitation strengthening. From the experiments, the present inventors confirmed that generally B 0.005 to 0.1 mass %, preferably B 0.01 to 0.07 mass % is required for exhibiting the effect. A too large B addition amount results in too large crystallized product during casting to cause problems in ingot quality, and a too small B addition amount provides no addition effect.

A precipitate of Mn and P provides an effect of forming a nucleation site for crystal grains during the solution treatment, but the precipitate takes no part in the precipitation strengthening. The effect is confirmed for a material containing generally 0.01 mass % or more and 0.5 mass % or less, preferably 0.02 to 0.3 mass % each of Mn and P added. A material containing Mn and P each in a too small amount exhibits no effect. Further, when an addition amount of each of Mn and P is too large, it causes problems of crack occurrence during hot working to inhibit working into a thin plate or sheet.

Other examples of the precipitate that provides an effect of suppressing increase of the crystal grain size to become too large, or forming a nucleation site for the crystal grains, in the solution treatment, include Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr. The copper alloy preferably contains at least one element selected from the group consisting of Al, Zr, Cr, C, Ti, Fe, In, As, Hf, Sb, Ta, and V in an amount of each generally 0.005 to 0.5 mass %, preferably 0.01 to 0.4 mass % for exhibiting the aforementioned effect. If the addition amount of these elements is too large, the resultant alloy forms a too large crystallized product during casting to cause a problem in quality of the resultant ingot, and if the addition amount is too small, no addition effect is provided.

Further, Zn, Sn, and Mg are preferably added to further improve the characteristics.

Zn is added preferably in an amount of 0.1 to 1.0 mass %. Zn is an element which forms a solid solution in a matrix, but Zn addition significantly alleviates solder embrittlement. The preferable primary uses of the alloy of the present invention are electric and electronic machinery and tools and electronic part materials such as vehicle terminals/connectors, relays, and switches. Most of them are joined by solder, and thus the alleviation of solder embrittlement is an important elemental technique.

Further, Zn addition may lower the melting point of the alloy, to control the states of formation of the precipitate composed of Ni and B and the precipitate composed of Mn and P. Both the precipitates are formed during solidification. Thus, a high solidification temperature of the alloy increases the grain size, to provide a small contribution of the precipitates to the effects of suppressing increase of the crystal grain size and forming a nucleation site for the crystal grains. The lower limit of Zn addition is defined as 0.1 mass %, because it is a minimum amount that provides alleviations in solder embrittlement. The upper limit of Zn addition is defined as 1.0 mass %, because a Zn addition amount more than 1.0 mass % may degrade the electrical conductivity.

Sn and Mg are also preferable elements for their uses. Sn and Mg addition provides an effect of improving creep resistance, which is emphasized in electronic machinery and tool terminals/connectors. The effect is also referred to as stress relaxing resistance, and it is an important elemental technique that assumes reliability of the terminals/connectors. Separate addition of Sn or Mg may improve the creep resistance, but Sn and Mg are elements that can further improve the creep resistance by a synergetic effect.

The lower limit of Sn addition is defined as 0.1 mass %, because it is a minimum amount that provides improvements in creep resistance. The upper limit of Sn addition is defined as 1 mass %, because an Sn addition amount more than 1 mass % may degrade the electrical conductivity.

The lower limit of Mg addition is defined as 0.05 mass %, because a too small Mg addition amount provides no effect of improving the creep resistance. The upper limit of Mg addition is defined as 0.5 mass %, because an Mg addition amount of more than 0.5 mass % not only saturates the effect but also may degrade hot-workability.

Sn and Mg have a function of accelerating formation of a precipitate composed of Ni and Si. It is important to add preferable amounts of Sn and Mg, serving as fine nucleation sites for the precipitate.

Next, an alloy structure of the copper alloy of the present invention will be described.

The precipitate X, which is an intermetallic compound composed of Ni and Si, has a grain size of 0.001 to 0.1 μm, preferably 0.003 to 0.05 μm, more preferably 0.005 to 0.02 μm. A too small grain size provides no strength enhancement; and a too large grain size, which is a generally-called over-aging state, results in no enhancement in mechanical strength and a poor bending property.

Herein (in the present specification, including the claims), a precipitate(s) other than the precipitate of the intermetallic compound composed of Ni and Si, is referred to as the precipitate Y. The precipitate Y has an effect of refining the crystal grains, through interaction with the Ni—Si precipitate X. The effect is remarkable in the presence of the precipitate X. The precipitate Y has a grain size of preferably 0.01 to 1 μm, more preferably 0.05 to 0.5 μm, most preferably 0.05 to 0.13 μm. A too small grain size provides no effect of suppressing the grain growth and increasing the numbers of nucleation sites, and a too large grain size degrades the bending property.

Next, the numbers of precipitates X and Y will be described. The number of grains of the precipitate X is preferably 20 to 2,000 times the number of grains of the precipitate Y. This is because the bending property is particularly excellent within the aforementioned range. When the number of grains of the precipitate X is too small, it may not provide a targeted mechanical strength, and when the number thereof is too large, it may degrade the bending property. The number of grains of the precipitate X is more preferably 100 to 1,500 times the number of grains of the precipitate Y. Herein, the number of grains of a precipitate means an average value per unit volume.

When the precipitate Y is an intermetallic compound that is one other than Ni—Si and is selected from the group consisting of Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr, the number of grains of the precipitate X is preferably $10^8$ to $10^{12}$ per $mm^2$, and the number of grains of the precipitate Y is preferably $10^4$ to $10^8$ per $mm^2$. This is because the aforementioned ranges provide particularly excellent bending property. If the number of precipitates is too small, the resultant alloy may not have a targeted mechanical strength. On the other hand, if the number of precipitates is too large, the resultant alloy may be poor in bending property. The number of grains of the precipitate X is more preferably $5\times10^9$ to $6\times10^{11}$ per $mm^2$, and the number of grains of the precipitate Y is more preferably $10^4$ to $4\times10^7$ per $mm^2$.

The effects of X and Y are more remarkable with the increased amounts of Ni and Si. The above specific X and Y as defined in the present invention, have realized, for the first time, a tensile strength of 800 MPa or more and a bending property of R/t<1.5, or a tensile strength of 900 MPa or more and a bending property of R/t<2, which are hitherto unattained properties.

The precipitates as referred to in the present invention include, for example, intermetallic compounds, carbides, oxides, sulfides, nitrides, compounds (solid solution), and elementary metals.

The copper alloy of the present invention has a crystal grain size of generally 20 μm or less, preferably 10.0 μm or less. A too large crystal grain size may not provide a tensile strength of 720 MPa or more and a bending property of R/t<2. The copper alloy has a crystal grain size of more preferably 8.5 μm or less. There is no particular restriction on the lower limit of the crystal grain size, but the copper alloy has a crystal grain size of generally 0.5 μm or more.

An example of a production method for the copper alloy of the present invention involves: melting a copper alloy having the aforementioned preferable element composition; casting into an ingot; and hot rolling the ingot by heating the ingot at a temperature rising rate of 20 to 200° C./hr, hot rolling the ingot at 850 to 1,050° C. for 0.5 to 5 hours, and quenching the ingot to a finished temperature of 300 to 700° C. after the hot rolling. In this way, the precipitates X and Y are formed. After hot rolling, for example, the resultant alloy is formed into a given thickness, through a combination of a solution treatment, annealing, and cold rolling.

The solution treatment is a heat treatment for allowing Ni and Si precipitated during casting or hot rolling to form a solid solution again and to recrystallize at the same time. The temperature of the solution treatment may be adjusted according to an Ni addition amount. For example, the solution treatment temperature is preferably 650° C. for an Ni amount of 2.0 mass % or more but less than 2.5 mass %, 800° C. for an Ni amount of 2.5 mass % or more but less than 3.0 mass %, 850° C. for an Ni amount of 3.0 mass % or more but less than 3.5 mass %, 900° C. for an Ni amount of 3.5 mass % or more but less than 4.0 mass %, 950° C. for an Ni amount of 4.0 mass % or more but less than 4.5 mass %, and 980° C. for an Ni amount of from 4.5 mass % to 5.0 mass %.

For example, the heat treatment at 850° C. of a material containing Ni 3.0 mass % allows sufficiently precipitated Ni and Si, to form again the solid solution and provide crystal grains of 10 μm or less. However, the heat treatment at the same temperature of an alloy having a Ni amount small er than 3.0 mass % causes growth of crystal grains into too large grains each having a grain size of not less than 10 μm. Further, a too large Ni amount may not provide an ideal solution state, and the mechanical strength may not be enhanced through the subsequent aging treatment.

The present invention apparently provides improvement in bending property, in particular, of a high strength copper alloy having a tensile strength of 800 MPa or more. Further, the present invention provides similar improvement in bending property of a copper alloy having a tensile strength of less than 800 MPa.

The copper alloy of the present invention is excellent in bending property and has an excellently high tensile strength, and it is preferable for lead frame, connector, and terminal materials for electric and electronic machinery and tools, in particular, for connector or terminal materials, relays, and switches, which may be used in automobiles.

According to the present invention, can be provided a copper alloy having better bending property than that of conventional alloys with the same level of tensile strength, which is particularly preferable for electric and electronic machinery and tools, through satisfactory attain both of a quite high tensile strength and an excellent bending property (R/t), by adding B, Mn, P, Al, Zr, Cr, C, Ti, Fe, In, As, Hf, Sb, Ta, V, or the like for controlling crystal grain sizes of a Cu—Ni—Si alloy and an alloy further containing Sn, Zn, and Mg in addition of the above alloy elements.

EXAMPLES

The present invention will be described in more detail based on examples given below, but the invention is not meant to be limited by these.

Example 1

An alloy containing Ni 4.2 mass %, Si 1.0 mass %, and Cr in the following amount, with the balance being Cu and unavoidable impurities, was melted in a high-frequency melting furnace. The amounts of Cr to be added in the copper alloys were 0.05 mass % in Example 1, 0.15 mass % in Example 2, 0.25 mass % in Example 3, 0.5 mass % in Example 4, 0.7 mass % in Example 5, 0.9 mass % in Example 6, 0.005 mass % in Comparative Examples 1, 0.2 mass % in Comparative Examples 2, 0.5 mass % in Comparative Examples 3, and 0.8 mass % in Comparative Examples 4, respectively. The resultant was cast at a cooling rate of 10 to 30° C./sec, to thereby obtain an ingot of thickness 30 mm, width 100 mm, and length 150 mm. The ingot was maintained at 900° C. for 1 hour, and was then subjected to hot rolling, to produce a hot rolled sheet having a thickness t of 12 mm. The sheet was subjected to chamfering in a thickness of 1 mm on both sides to a thickness t of 10 mm, and it was then finished into a thickness of t=0.167 mm through cold rolling. The sheet material was subjected to a solution treatment at 950° C. for 20 sec.

Immediately after the solution treatment, the sheet material was subjected to water quenching. Then, the alloys each were subjected to an aging treatment at 450 to 500° C. for 2 hours and cold rolling at a working ratio of 10%, to thereby obtain a sample of t=0.15 mm.

The following characteristics of the thus-obtained samples were tested and evaluated as mentioned in below.

a. Electrical Conductivity

Electrical conductivity was calculated by measuring a specific resistance of the sample through a four terminal method in a thermostatic bath maintained at 20° C. (±0.5° C.). The distance between the terminals was set to 100 mm.

b. Tensile Strength

Tensile strengths of 3 test pieces prepared according to JIS Z 2201-13B cut out from the sample in a direction parallel to the rolling direction, were measured according to JIS Z 2241, and an average value thereof was obtained.

c. Bending Property

A test piece was cut out from the sample in a direction parallel to the rolling direction into a size of width 10 mm and length 25 mm. The resultant test piece was W-bent at 90° at a bending radius R that would be 0, 0.1, 0.15, 0.2, 0.25, 0.3, 0.4, 0.5, or 0.6 (mm), with a bending axis being perpendicular to the rolling direction. Whether cracks was occurred or not at the bent portion, was observed with the naked eye through observation with an optical microscope of 50 times magnification, and the bent sites were observed with a scanning electron microscope to examine whether cracks were observed or not. Evaluation results are designated by R/t (in which R represents a bending radius, and t represents a sheet thickness), and the R/t was calculated by employing a (limit) maximum R at which crack was occurred. If no cracks are formed at R=0.15 and cracks are formed at R=0.1, since the sample had a thickness (t)=0.15 mm, R/t=0.15/0.15=1 is obtained, which is shown in the following table.

d. Grain Size and Distribution Density of Precipitate

The sample was punched out into a shape of a disc of diameter 3 mm, and the resultant was subjected to thin-film-polishing by using a twinjet polishing method. Photographs (5,000 and 100,000 times magnification) of the resultant sample were taken at 3 arbitrary positions with a transmission electron microscope at an accelerating voltage of 300 kV, and the grain size and the density of the precipitate were measured on the photographs. Measurement of the grain size and the density of the precipitate were carried out in the following manner: setting an incident electron beam azimuth to [001], and measuring the number of fine grains of the precipitate X composed of Ni—Si in a high-power photograph (100,000 times magnification) at n=100 (n represents the number of viewing fields for observation), since the precipitate X was fine; and, on the other hand, measuring the number of grains of the precipitate Y in a low-power photograph (5,000 times magnification) at n=10; thereby to eliminate the localized bias on the numbers. The numbers were calculated into numbers per unit area (/mm$^2$).

As is apparent from the results shown in Table 1, the copper alloys of Examples according to the present invention each had excellent characteristics in both the mechanical strength and the bending property. However, contrary to the above, the copper alloys of Comparative Examples 1 and 3 each had a grain size of the precipitate X that did not fall in the range defined in the present invention, and the copper alloys of Comparative Example 2 and 4 each had a grain size of the precipitate Y that did not fall in the range defined in the present invention. Thus, the copper alloys of these Comparative Examples each were conspicuously poor in bending property being R/t≥2, even they each had substantially the same mechanical strength as those of Examples.

TABLE 1

| | Grain size of X μm | Grain size of Y μm | (Number of grains of X)/(number of grains of Y) | Tensile strength MPa | Bending property R/t |
|---|---|---|---|---|---|
| Example 1 | 0.003 | 0.03 | 100 | 911 | 1.67 |
| Example 2 | 0.03 | 0.05 | 320 | 921 | 1.67 |
| Example 3 | 0.08 | 0.09 | 210 | 908 | 1.67 |
| Example 4 | 0.02 | 0.08 | 530 | 903 | 1.67 |
| Example 5 | 0.07 | 0.02 | 360 | 921 | 1.67 |
| Example 6 | 0.04 | 0.03 | 830 | 918 | 1.67 |
| Comparative example 1 | 0.0003 | 0.05 | 780 | 912 | 2 |
| Comparative example 2 | 0.04 | 0.003 | 150 | 925 | 2 |
| Comparative example 3 | 0.5 | 0.03 | 950 | 923 | 2.67 |
| Comparative example 4 | 0.06 | 1.2 | 740 | 915 | 3.3 |

Example 2

The copper alloys each having the composition, as shown in Table 2, with the balance being Cu and unavoidable impurities, were tested and evaluated in the same manner as in Example 1. The production method and the measurement method were the same as those in Example 1.

As is apparent from the results shown in Table 2, the copper alloys of Examples according to the present invention each had excellent characteristics in both the mechanical strength and the bending property. However, on the contrary, the copper alloy of Comparative Example 5 had the Ni amount smaller than the preferable lower limit of the range in the present invention, and thus failed to give the targeted tensile strength. The copper alloy of Comparative Example 6 had a large Ni amount, and occurred cracks during working, and thus failed to produce a material for evaluation. The copper alloys of Comparative Examples 7 and 8 each had a B amount and a ratio of the numbers of Xs to Ys that did not fall in the respective ranges defined in the present invention, and thus failed to give the targeted mechanical strength and the bending property in combination.

TABLE 2

| | Elements | | | | Grain | Grain | (Number of grains of X)/(number | Tensile | Bending | Electrical |
|---|---|---|---|---|---|---|---|---|---|---|
| | Ni mass % | Si mass % | B mass % | Other mass % | size of X μm | size of Y μm | of grains of Y) | strength MPa | property R/t | conductivity % IACS |
| Example 7 | 2.20 | 0.50 | 0.050 | — | 0.002 | 0.13 | 150 | 721 | 1 | 42.0 |
| Example 8 | 2.70 | 0.64 | 0.060 | — | 0.002 | 0.05 | 350 | 772 | 1 | 41.0 |
| Example 9 | 3.30 | 0.79 | 0.040 | — | 0.002 | 0.5 | 330 | 813 | 1.5 | 39.0 |
| Example 10 | 3.80 | 0.90 | 0.050 | — | 0.003 | 0.18 | 500 | 861 | 1.5 | 37.0 |
| Example 11 | 4.20 | 1.00 | 0.040 | — | 0.002 | 0.7 | 450 | 903 | 1.5 | 35.5 |
| Example 12 | 3.80 | 0.90 | 0.009 | — | 0.002 | 0.3 | 1050 | 844 | 1.5 | 37.0 |
| Example 13 | 3.80 | 0.90 | 0.085 | — | 0.003 | 0.05 | 320 | 838 | 1.5 | 37.0 |
| Example 14 | 4.20 | 1.00 | 0.008 | — | 0.002 | 0.24 | 1400 | 913 | 1.67 | 35.5 |
| Example 15 | 4.20 | 1.00 | 0.094 | — | 0.002 | 0.8 | 630 | 909 | 1.67 | 35.5 |
| Example 16 | 2.25 | 0.51 | 0.030 | Zn 0.15 | 0.002 | 0.11 | 150 | 721 | 1 | 41.0 |
| Example 17 | 3.35 | 0.82 | 0.050 | Sn 0.12<br>Mg 0.07 | 0.002 | 0.23 | 340 | 811 | 1.5 | 38.0 |
| Example 18 | 4.05 | 0.98 | 0.065 | Zn 0.95<br>Sn 0.80<br>Mg 0.40 | 0.002 | 0.28 | 550 | 902 | 1.67 | 36.2 |
| Comparative example 5 | 1.50 | 0.25 | 0.050 | — | 0.002 | 0.1 | 450 | 600 | 1 | 45.0 |
| Comparative example 6 | 6.50 | 1.50 | 0.060 | — | No sample was made | | | | | |

TABLE 2-continued

| | Elements | | | | Grain | Grain | (Number of grains of X)/(number | Tensile | Bending | Electrical |
|---|---|---|---|---|---|---|---|---|---|---|
| | Ni mass % | Si mass % | B mass % | Other mass % | size of X μm | size of Y μm | of grains of Y) | strength MPa | property R/t | conductivity % IACS |
| Comparative example 7 | 3.80 | 0.90 | 0.001 | — | 0.002 | 0.003 | >2000 | 866 | 2 | 37.0 |
| Comparative example 8 | 3.80 | 0.90 | 0.500 | — | 0.001 | 1.2 | 10 | 780 | 2.67 | 37.0 |

Note;
"—" not added

Example 3

The copper alloys each having the composition, as shown in Table 3, with the balance being Cu and unavoidable impurities, were tested and evaluated in the same manner as in Example 1. The production method and the measurement method were the same as those in Example 1.

As is apparent from the results shown in Table 3, the copper alloys of Examples according to the present invention each had excellent characteristics in both the mechanical strength and the bending property. However, on the contrary, the copper alloy of Comparative Example 9 had the Ni and Si amounts smaller than the preferable lower limits of the respective ranges in the present invention, and thus failed to give the targeted tensile strength. The copper alloy of Comparative Example 10 had large Ni and Si amounts, and occurred cracks during working, and thus failed to produce a material for evaluation. The copper alloys of Comparative Examples 11 to 14 each had a Mn amount and/or a P amount that did not fall in the ranges defined in the present invention, and/or a ratio of the numbers of grains of X to that of Y that did not fall in the range defined in the present invention. Thus, the copper alloys of these Comparative examples each were poor in bending property being R/t of 2 or more.

TABLE 3

| | Elements | | | | | Grain | Grain | (Number of grains of X)/(number | Tensile | Bending | Electrical |
|---|---|---|---|---|---|---|---|---|---|---|---|
| | Ni mass % | Si mass % | Mn mass % | P mass % | Other mass % | size of X μm | size of Y μm | of grains of Y) | strength MPa | property R/t | conductivity % IACS |
| Example 19 | 2.20 | 0.50 | 0.100 | 0.100 | — | 0.002 | 0.08 | 450 | 728 | 1 | 42.0 |
| Example 20 | 2.70 | 0.64 | 0.120 | 0.090 | — | 0.002 | 0.1 | 480 | 758 | 1.5 | 41.0 |
| Example 21 | 3.30 | 0.79 | 0.080 | 0.110 | — | 0.003 | 0.5 | 1020 | 811 | 1.5 | 39.0 |
| Example 22 | 3.80 | 0.90 | 0.110 | 0.120 | — | 0.002 | 0.12 | 140 | 883 | 1.5 | 37.0 |
| Example 23 | 4.20 | 1.00 | 0.090 | 0.100 | — | 0.002 | 0.44 | 90 | 921 | 1.67 | 35.5 |
| Example 24 | 3.80 | 0.90 | 0.020 | 0.030 | — | 0.002 | 0.13 | 420 | 873 | 1.5 | 37.0 |
| Example 25 | 3.80 | 0.90 | 0.450 | 0.230 | — | 0.003 | 0.07 | 1080 | 833 | 1.5 | 37.0 |
| Example 26 | 4.20 | 1.00 | 0.030 | 0.040 | — | 0.003 | 0.08 | 80 | 918 | 1.67 | 35.5 |
| Example 27 | 4.20 | 1.00 | 0.310 | 0.390 | — | 0.002 | 0.18 | 950 | 928 | 1.67 | 35.5 |
| Example 28 | 2.21 | 0.53 | 0.030 | 0.025 | Mg 0.20 | 0.002 | 0.11 | 122 | 720 | 1 | 41.5 |
| Example 29 | 3.32 | 0.86 | 0.050 | 0.022 | Zn 0.15<br>Sn 0.30 | 0.002 | 0.23 | 345 | 808 | 1.5 | 38.2 |
| Example 30 | 4.06 | 0.99 | 0.082 | 0.040 | Zn 0.90<br>Sn 0.50<br>Mg 0.45 | 0.002 | 0.28 | 454 | 900 | 1.67 | 36.9 |
| Comparative example 9 | 1.50 | 0.25 | 0.120 | 0.090 | — | 0.002 | 0.12 | 620 | 662 | 1 | 45.0 |
| Comparative example 10 | 6.50 | 1.50 | 0.110 | 0.120 | — | | | No sample was made | | | |
| Comparative example 11 | 3.80 | 0.90 | 0.003 | 0.090 | — | 0.003 | 0.03 | 10 | 913 | 2 | 37.0 |
| Comparative example 12 | 3.80 | 0.90 | 0.110 | 0.005 | — | 0.003 | 0.31 | 13 | 921 | 2 | 37.0 |
| Comparative example 13 | 3.80 | 0.90 | 0.670 | 0.090 | — | 0.002 | 0.06 | 14 | 908 | 2.67 | 37.0 |
| Comparative example 14 | 3.80 | 0.90 | 0.130 | 0.730 | — | 0.002 | 0.13 | 12 | 903 | 2.67 | 37.0 |

Note;
"—" not added

Example 4

The copper alloys each containing Ni 4.2 mass %, Si 1.0 mass %, and the elements as shown in Table 4, with the balance being Cu and unavoidable impurities, were tested and evaluated in the same manner as in Example 1. The production method and the measurement method were the same as those in Example 1.

As is apparent from the results shown in Table 4, the copper alloys of Examples according to the present invention each had a tensile strength of 900 MPa or more and R/t<2. However, on the contrary, the copper alloy of Comparative Example 15 had a B amount and a ratio of the numbers of grains of X to that of Y that did not fall in the ranges defined in the present invention. The copper alloy of Comparative Example 16 had an Mn amount and a grain size of the precipitate Y that did not fall in the ranges defined in the present invention. The copper alloy of Comparative Example 17 had a P amount and a grain size of the precipitate Y that did not fall in the ranges defined in the present invention. The copper alloy of Comparative Example 18 had an Mn amount and a ratio of the numbers of grains of X to that of Y that did not fall in the ranges defined in the present invention. The copper alloy of Comparative Example 19 had a P amount and a ratio of the numbers of grains of X to that of Y that did not fall in the ranges defined in the present invention. Thus, the copper alloys of these Comparative examples each were poor in bending property being R/t of 2 or more.

TABLE 4

| | Elements | | | | Grain | Grain | (Number of grains of | Tensile | Bending | Electrical |
|---|---|---|---|---|---|---|---|---|---|---|
| | B mass % | Mn mass % | P mass % | Other mass % | size of X μm | size of Y μm | X)/(number of grains of Y) | strength MPa | property R/t | conductivity % IACS |
| Example 31 | 0.050 | 0.100 | 0.100 | — | 0.003 | 0.13 | 150 | 904 | 1.67 | 35.5 |
| Example 32 | 0.008 | 0.120 | 0.090 | — | 0.002 | 0.82 | 780 | 911 | 1.67 | 35.5 |
| Example 33 | 0.094 | 0.080 | 0.110 | — | 0.003 | 0.08 | 1020 | 903 | 1.67 | 35.5 |
| Example 34 | 0.050 | 0.020 | 0.030 | — | 0.003 | 0.09 | 180 | 908 | 1.67 | 35.5 |
| Example 35 | 0.050 | 0.450 | 0.230 | — | 0.002 | 0.45 | 330 | 921 | 1.67 | 35.5 |
| Example 36 | 0.055 | 0.025 | 0.025 | Sn 0.30 | 0.003 | 0.54 | 234 | 902 | 1.67 | 35.2 |
| Example 37 | 0.015 | 0.200 | 0.150 | Zn 0.20<br>Mg 0.08 | 0.002 | 0.67 | 332 | 901 | 1.67 | 34.2 |
| Example 38 | 0.020 | 0.025 | 0.025 | Zn 0.80<br>Sn 0.60<br>Mg 0.20 | 0.003 | 0.7 | 441 | 905 | 1.67 | 34.9 |
| Comparative example 15 | 0.500 | 0.120 | 0.090 | — | 0.002 | 0.45 | 11 | 921 | 2.67 | 35.5 |
| Comparative example 16 | 0.050 | 0.003 | 0.090 | — | 0.003 | 0.007 | 400 | 905 | 2.67 | 35.5 |
| Comparative example 17 | 0.050 | 0.110 | 0.005 | — | 0.003 | 0.005 | 580 | 913 | 3.3 | 35.5 |
| Comparative example 18 | 0.050 | 0.670 | 0.090 | — | 0.002 | 0.25 | 5 | 909 | 3.3 | 35.5 |
| Comparative example 19 | 0.050 | 0.130 | 0.730 | — | 0.002 | 0.7 | 8 | 915 | 2.67 | 35.5 |

Note;
"—" not added

Example 5

The copper alloys each containing Ni, Si, and Sb, as shown in Table 5, with the balance being Cu and unavoidable impurities, were tested and evaluated in the same manner as in Example 1, and crystal grain diameters thereof were measured. The production method and the measurement method were the same as those in Example 1. The amounts of Sb to be added in the copper alloys of Comparative Examples 28, 29, 30, and 31 were 0.01 mass %, 1.0 mass %, 0.02 mass %, and 1.2 mass %, respectively. The Sb amounts of the other copper alloys each were 0.1 mass %.

The crystal grain size was measured according to JIS H 0501 (section method). The bending property was evaluated by: as designated "GW", the aforementioned samples each cut out parallel to the rolling direction into a size of width 10 mm and length 25 mm, and bent with a bending axis perpendicular to the rolling direction; and, as designated "BW", the samples each cut out parallel to the rolling direction into a size of width 25 mm and length 10 mm, bent in the same manner as that in GW but with a bending axis parallel to the rolling direction, and examined in the same manner as that in GW through observation of bent portions.

As is apparent from the results shown in Table 5, the copper alloys of Examples according to the present invention each had excellent characteristics. However, contrary to the above, the copper alloy of Comparative Example 20 had a too small Ni amount, and thus it had a low precipitation density of the precipitate X, and was poor in tensile characteristics. The copper alloy of Comparative Example 21 had a large Ni amount, and thus it suffered severe working cracks, although it was worked into a final thickness. Accordingly, although the copper alloy structure of the resultant sample in this Comparative Example 21 was examined, it was impossible to examine characteristics thereof. The copper alloy of Comparative Example 22 had a too small Si amount, and thus it had a low precipitation density of the precipitate X, and was poor in tensile characteristics. The copper alloy of Comparative Example 23 had a too large Si amount, and thus it suffered severe working cracks, although it was worked into a final thickness. Accordingly, although the copper alloy structure of the resultant sample in this Comparative Example 23 was examined, it was impossible to examine characteristics thereof. The copper alloy of Comparative Example 24 had a small grain size of the precipitate X, the copper alloy of Comparative Example 25 had a large grain size of the precipitate X, and the copper alloy of Comparative Example 26 had a too low precipitation density of the precipitate X, and thus these copper alloys each were poor in tensile characteristics. The copper alloy of Comparative Example 27 had a large Si amount, and thus had a high precipitation density of the precipitate X, resulting in brittle cracking. The copper alloy of Comparative Example 27 suffered severe working cracks, although it was worked into a final thickness. Accordingly, although the copper alloy structure of the resultant sample in this Comparative Example 27 was examined, it was impossible to examine characteristics thereof. The copper alloy of Comparative Example 28 had a small grain size of the precipitate Y, the copper alloy of Comparative Example 29 had a large grain size of the precipitate Y, and the copper alloy of Comparative Example 30 had a too low precipitation density of the precipitate Y, and thus these copper alloys each had a too large crystal grain size, and were poor in bending property. The copper alloy of Comparative Example 31 had a high precipitation density of the precipitate Y, resulting in brittle cracking. The copper alloy of Comparative Example 31 suffered severe working cracks, although it was worked into a final thickness. Accordingly, although the copper alloy structure of the resultant sample in this Comparative Example 31 was examined, it was impossible to examine characteristics thereof.

TABLE 5

| | Elements | | Precipitate X | | Precipitate Y | | Crystal | | | Bending | Bending |
|---|---|---|---|---|---|---|---|---|---|---|---|
| | Ni mass % | Si mass % | Grain size μm | Density/ $mm^2$ | Grain size μm | Density/ $mm^2$ | grain size μm | Tensile strength MPa | Electrical conductivity % IACS | property GW R/t | property BW R/t |
| Example 39 | 3.8 | 0.9 | 0.025 | $6 \times 10^{10}$ | 0.210 | $3 \times 10^5$ | 8 | 830 | 35 | 1 | 1 |
| Example 40 | 3.5 | 0.8 | 0.023 | $2 \times 10^{10}$ | 0.220 | $5 \times 10^5$ | 10 | 844 | 35 | 1 | 1 |
| Example 41 | 4.2 | 1.2 | 0.026 | $2 \times 10^{11}$ | 0.230 | $7 \times 10^5$ | 9 | 908 | 32 | 1.5 | 1.5 |
| Example 42 | 2.1 | 0.5 | 0.028 | $3 \times 10^8$ | 0.320 | $4 \times 10^5$ | 8 | 710 | 39 | 1 | 1 |
| Comparative example 20 | 1.8 | 0.5 | 0.024 | $7 \times 10^7$ | 0.300 | $3 \times 10^5$ | 11 | 610 | 45 | 1 | 1 |
| Comparative example 21 | 5.5 | 1.3 | 0.029 | $8 \times 10^{11}$ | 0.280 | $5 \times 10^5$ | 9 | Not measurable due to working cracks | | | |
| Comparative example 22 | 2 | 0.25 | 0.022 | $3 \times 10^7$ | 0.240 | $4 \times 10^5$ | 10 | 704 | 39 | 1 | 1 |
| Comparative example 23 | 5.2 | 1.9 | 0.029 | $9 \times 10^{11}$ | 0.310 | $7 \times 10^5$ | 12 | Not measurable due to working cracks | | | |
| Comparative example 24 | 3.5 | 0.8 | 0.0001 | $5 \times 10^{10}$ | 0.330 | $9 \times 10^5$ | 10 | 755 | 30 | 1 | 1 |
| Comparative example 25 | 3.6 | 0.8 | 0.112 | $6 \times 10^{10}$ | 0.290 | $7 \times 10^5$ | 9 | 789 | 37 | 1 | 1 |
| Comparative example 26 | 3 | 0.7 | 0.030 | $5 \times 10^6$ | 0.300 | $8 \times 10^5$ | 8 | 739 | 33 | 1 | 1 |
| Comparative example 27 | 4.8 | 1.55 | 0.028 | $4 \times 10^{13}$ | 0.280 | $3 \times 10^5$ | 10 | Not measurable due to working cracks | | | |
| Comparative example 28 | 3.9 | 0.8 | 0.033 | $5 \times 10^{10}$ | 0.008 | $7 \times 10^5$ | 40 | 829 | 35 | 3 | 4 |
| Comparative example 29 | 3.4 | 0.6 | 0.031 | $6 \times 10^{10}$ | 1.260 | $2 \times 10^5$ | 66 | 822 | 38 | 3 | 3 |
| Comparative example 30 | 3.6 | 0.7 | 0.029 | $3 \times 10^{10}$ | 0.330 | $7 \times 10^3$ | 26 | 840 | 35 | 2 | 2 |
| Comparative example 31 | 3.5 | 0.6 | 0.032 | $5 \times 10^{10}$ | 0.230 | $8 \times 10^9$ | 6 | Not measurable due to working cracks | | | |

Example 6

The copper alloys each containing Ni, Si, and Cr, as shown in Table 6 and below, with the balance being Cu and unavoidable impurities, were tested and evaluated in the same manner as that in Example 5. The production method and the measurement method were the same as those in Example 5. The Cr amounts of the copper alloys of Comparative Examples 40, 41, 42, and 43 were 0.005 mass %, 0.8 mass %, 0.01 mass %, and 1.0 mass %, respectively. Each of the Cr amounts of the other copper alloys was 0.05 mass %.

As is apparent from the results shown in Table 6, the copper alloys of Examples according to the present invention each had excellent characteristics. However, contrary to the above, the copper alloy of Comparative Example 32 had a too small Ni amount, and thus had a low precipitation density of the precipitate X, and it was poor in tensile characteristics. The copper alloy of Comparative Example 33 had large Ni and Si amounts, and thus suffered severe working cracks, although it was worked into a final thickness. Accordingly, although the copper alloy structure of the resultant sample in this Comparative Example 33 was examined, it was impossible to examine characteristics thereof. The copper alloy of Comparative Example 34 had a small Si amount, and thus had a low precipitation density of the precipitate X, and it was poor in tensile characteristics. The copper alloy of Comparative Example 35 had a large Si amount, and thus suffered severe working cracks, although it was worked into a final thickness. Accordingly, although the copper alloy structure of the resultant sample in this Comparative Example 35 was examined, it was impossible to examine characteristics thereof. The copper alloy of Comparative Example 36 had a small grain size of the precipitate X, the copper alloy of Comparative Example 37 had a large grain size of the precipitate X, and the copper alloy of Comparative Example 38 had a too low precipitation density of the precipitate X, and thus these copper alloys for comparison each were poor in tensile characteristics. The copper alloy of Comparative Example 39 had a high precipitation density of the precipitate X, resulting in brittle cracking. The copper alloy of Comparative Example 39 suffered severe working cracks, although it was worked into a final thickness. Accordingly, although the copper alloy structure of the resultant sample in this Comparative Example 39 was examined, it was impossible to examine characteristics thereof. The copper alloy of Comparative Example 40 had a small grain size of the precipitate Y, the copper alloy of Comparative Example 41 had a large grain size of the precipitate Y, and the copper alloy of Comparative Example 42 had a too low precipitation density of the precipitate Y, and thus these copper alloys for comparison each had a too large crystal grain size, and were poor in bending property. The copper alloy of Comparative Example 43 had a high precipitation density of the precipitate Y, resulting in brittle cracking. The copper alloy of Comparative Example 43 suffered severe working cracks, although it was worked into a final thickness. Accordingly, although the copper alloy structure of the resultant sample in this Comparative Example 43 was examined, it was impossible to examine characteristics thereof.

TABLE 6

| | Elements | | Precipitate X | | Precipitate Y | | Crystal | | | Bending | Bending |
|---|---|---|---|---|---|---|---|---|---|---|---|
| | Ni mass % | Si mass % | Grain size μm | Density/ $mm^2$ | Grain size μm | Density/ $mm^2$ | grain size μm | Tensile strength MPa | Electrical conductivity % IACS | property GW R/t | property BW R/t |
| Example 43 | 3.9 | 0.8 | 0.023 | $5 \times 10^{10}$ | 0.250 | $2 \times 10^5$ | 9 | 821 | 35 | 1 | 1 |
| Example 44 | 3.7 | 0.8 | 0.020 | $3 \times 10^{10}$ | 0.290 | $4 \times 10^5$ | 12 | 856 | 35 | 1 | 1 |
| Example 45 | 4.3 | 1.1 | 0.025 | $3 \times 10^{11}$ | 0.210 | $9 \times 10^5$ | 11 | 921 | 32 | 1.5 | 1.5 |
| Example 46 | 2.3 | 0.6 | 0.029 | $4 \times 10^8$ | 0.300 | $5 \times 10^5$ | 9 | 709 | 40 | 1 | 1 |
| Comparative example 32 | 1.8 | 0.5 | 0.024 | $7 \times 10^7$ | 0.300 | $3 \times 10^5$ | 11 | 600 | 46 | 1 | 1 |
| Comparative example 33 | 5.5 | 1.57 | 0.022 | $9 \times 10^{11}$ | 0.220 | $6 \times 10^5$ | 9 | Not measurable due to working cracks | | | |
| Comparative example 34 | 2.1 | 0.25 | 0.028 | $4 \times 10^7$ | 0.250 | $5 \times 10^5$ | 13 | 640 | 38 | 1 | 1 |
| Comparative example 35 | 5.1 | 1.9 | 0.029 | $8 \times 10^{11}$ | 0.330 | $7 \times 10^5$ | 18 | Not measurable due to working cracks | | | |
| Comparative example 36 | 3.5 | 0.9 | 0.0005 | $6 \times 10^{10}$ | 0.380 | $8 \times 10^5$ | 14 | 779 | 32 | 1 | 1 |
| Comparative example 37 | 3.5 | 0.9 | 0.122 | $6 \times 10^{10}$ | 0.240 | $6 \times 10^5$ | 11 | 746 | 38 | 1 | 1 |
| Comparative example 38 | 3.1 | 0.8 | 0.028 | $7 \times 10^6$ | 0.320 | $5 \times 10^5$ | 13 | 756 | 31 | 1 | 1 |
| Comparative example 39 | 4.9 | 1.5 | 0.030 | $5 \times 10^{13}$ | 0.300 | $5 \times 10^5$ | 12 | Not measurable due to working cracks | | | |
| Comparative example 40 | 3.8 | 0.9 | 0.032 | $6 \times 10^{10}$ | 0.007 | $8 \times 10^5$ | 45 | 833 | 37 | 3 | 4 |
| Comparative example 41 | 3.5 | 0.7 | 0.034 | $7 \times 10^{10}$ | 1.330 | $3 \times 10^5$ | 54 | 850 | 35 | 3 | 3 |
| Comparative example 42 | 3.7 | 0.8 | 0.032 | $4 \times 10^{10}$ | 0.300 | $8 \times 10^3$ | 32 | 832 | 34 | 2 | 2 |
| Comparative example 43 | 3.4 | 0.8 | 0.035 | $4 \times 10^{10}$ | 0.200 | $9 \times 10^9$ | 5 | Not measurable due to working cracks | | | |

Example 7

With respect to each of the following Examples according to the present invention, the copper alloys each containing Ni 4.0 mass %, Si 1.0 mass %, and the elements as shown in Table 7, with the balance being Cu and unavoidable impurities, were tested and evaluated in the same manner as in Example 5. The production method and the measurement method were the same as those in Example 5. The copper alloy of Comparative Example 44 had Ni 3.1 mass % and Si 0.7 mass %, the copper alloy of Comparative Example 45 had Ni 3.9 mass % and Si 0.9 mass %, and the copper alloy of Comparative Example 46 had Ni 4.9 mass % and Si 1.2 mass %, each with the balance being Cu and unavoidable impurities.

As is apparent from the results shown in Table 7, the copper alloys of Examples according to the present invention each had excellent characteristics. However, contrary to the above, the copper alloys of Comparative Examples 44, 45, and 46 each did not contain any precipitate Y, and thus each had a conspicuously large crystal grain size, and were poor in bending property.

TABLE 7

| | Added | Precipitate X | | Precipitate Y | | Crystal | | | Bending | Bending |
|---|---|---|---|---|---|---|---|---|---|---|
| | components Element: amount mass % | Grain size μm | Density/ $mm^2$ | Grain size μm | Density/ $mm^2$ | grain size μm | Tensile strength MPa | Electrical conductivity % IACS | property GW R/t | property BW R/t |
| Example 47 | Al 0.1, As 0.05 | 0.025 | $5 \times 10^{10}$ | 0.103 | $3 \times 10^6$ | 12 | 813 | 29 | 1.5 | 1.5 |
| Example 48 | Al 0.08, Hf 0.09 | 0.024 | $4 \times 10^{10}$ | 0.400 | $2 \times 10^7$ | 11 | 814 | 28 | 1.5 | 1.5 |
| Example 49 | Al 0.07, Zr 0.1 | 0.024 | $4 \times 10^{10}$ | 0.200 | $4 \times 10^6$ | 18 | 843 | 31 | 1.5 | 1.5 |
| Example 50 | Cr 0.03 | 0.023 | $6 \times 10^{10}$ | 0.340 | $4 \times 10^6$ | 15 | 812 | 33 | 1.5 | 1.5 |
| Example 51 | Ti 0.1, C 0.03 | 0.014 | $5 \times 10^{11}$ | 0.980 | $2 \times 10^4$ | 18 | 836 | 39 | 1.5 | 1.5 |
| Example 52 | Ti 0.06, C 0.02 | 0.024 | $4 \times 10^{10}$ | 0.760 | $1 \times 10^4$ | 13 | 834 | 38 | 1.5 | 1.5 |
| Example 53 | Zr 0.2 | 0.027 | $5 \times 10^{10}$ | 0.340 | $3 \times 10^6$ | 18 | 832 | 34 | 1.5 | 1.5 |
| Example 54 | Cr 0.3 | 0.026 | $6 \times 10^{10}$ | 0.550 | $3 \times 10^6$ | 14 | 824 | 35 | 1.5 | 1.5 |
| Example 55 | Fe 0.1, P 0.05 | 0.028 | $3 \times 10^{10}$ | 0.220 | $3 \times 10^6$ | 10 | 856 | 35 | 1.5 | 1.5 |

TABLE 7-continued

| | Added components Element: amount mass % | Precipitate X Grain size μm | Precipitate X Density/ mm² | Precipitate Y Grain size μm | Precipitate Y Density/ mm² | Crystal grain size μm | Tensile strength MPa | Electrical conductivity % IACS | Bending property GW R/t | Bending property BW R/t |
|---|---|---|---|---|---|---|---|---|---|---|
| Example 56 | Fe 0.2, P 0.05 | 0.018 | $7 \times 10^{10}$ | 0.1203 | $\times 10^{7}$ | 9 | 812 | 39 | 1.5 | 1.5 |
| Example 57 | Fe 0.1, Zr 0.1 | 0.025 | $7 \times 10^{10}$ | 0.4507 | $\times 10^{5}$ | 8 | 822 | 35 | 1.5 | 1.5 |
| Example 58 | In 0.02 | 0.025 | $4 \times 10^{10}$ | 0.6604 | $\times 10^{5}$ | 12 | 834 | 38 | 1.5 | 1.5 |
| Example 59 | Mg 0.1, Sb 0.04 | 0.026 | $8 \times 10^{9}$ | 0.4302 | $\times 10^{6}$ | 15 | 814 | 28 | 1.5 | 1.5 |
| Example 60 | Mn 0.2 | 0.018 | $6 \times 10^{10}$ | 0.4007 | $\times 10^{5}$ | 11 | 808 | 31 | 1.5 | 1.5 |
| Example 61 | Sb 0.05 | 0.019 | $6 \times 10^{10}$ | 0.2403 | $\times 10^{5}$ | 10 | 806 | 33 | 1.5 | 1.5 |
| Example 62 | Ta 0.1 | 0.027 | $3 \times 10^{10}$ | 0.4302 | $\times 10^{6}$ | 8 | 842 | 37 | 1.5 | 1.5 |
| Example 63 | V 0.08, Zr 0.08 | 0.026 | $3 \times 10^{10}$ | 0.8409 | $\times 10^{5}$ | 13 | 813 | 36 | 1.5 | 1.5 |
| Comparative example 44 | — | 0.022 | $8 \times 10^{9}$ | None | None | 29 | 803 | 39 | 2 | 2 |
| Comparative example 45 | — | 0.025 | $4 \times 10^{10}$ | None | None | 30 | 823 | 36 | 3 | 3 |
| Comparative example 46 | — | 0.029 | $8 \times 10^{9}$ | None | None | 33 | 890 | 32 | 4 | 3 |

Note;
"—" not added

Example 8

The copper alloys each containing Ni, Si, Sn, Zn, Mg, and the elements as shown in Table 8, with the balance being Cu and unavoidable impurities, were tested and evaluated in the same manner as in Example 5. The production method and the measurement method were the same as those in Example 5.

As is apparent from the results shown in Table 7, the copper alloys of Examples according to the present invention each had excellent characteristics. However, contrary to the above, the copper alloys of Comparative Examples 47, 48, 49, and 50 each did not contain any precipitate Y, and thus each had a conspicuously large crystal grain size, and were poor in bending property.

INDUSTRIAL APPLICABILITY

The copper alloy of the present invention can be preferably applied to lead frame, connector, or terminal materials for electric and electronic machinery and tools, e.g. automobile connector/terminal materials, relays, and switches.

Having described our invention as related to the present embodiments, it is our intention that the invention not be limited by any of the details of the description, unless otherwise specified, but rather be construed broadly within its spirit and scope as set out in the accompanying claims.

We claim:

1. A method of producing a copper alloy comprising the sequential steps of:

TABLE 8

| | Elements (mass %) Ni | Si | Sn | Zn | Mg | Other | Precipitate X Grain size μm | Precipitate X Density/ mm² | Precipitate Y Grain size μm | Precipitate Y Density/ mm² | Crystal grain size μm | Tensile strength MPa | Electrical conductivity % IACS | Bending property GW R/t | Bending property BW R/t |
|---|---|---|---|---|---|---|---|---|---|---|---|---|---|---|---|
| Example 64 | 3 | 0.8 | 0.1 | 0.5 | 0.1 | Sb 0.08 | 0.025 | $2 \times 10^{10}$ | 0.200 | $2 \times 10^{6}$ | 12 | 811 | 37 | 0.75 | 0.5 |
| Example 65 | 3.5 | 0.9 | | | | | 0.024 | $6 \times 10^{10}$ | 0.325 | $3 \times 10^{6}$ | 11 | 842 | 35 | 0.75 | 0.75 |
| Example 66 | 4 | 1.1 | | | | | 0.024 | $4 \times 10^{10}$ | 0.250 | $3 \times 10^{6}$ | 18 | 865 | 33 | 1 | 1 |
| Example 67 | 4.5 | 1.3 | | | | | 0.023 | $9 \times 10^{10}$ | 0.230 | $4 \times 10^{6}$ | 15 | 891 | 31 | 1.5 | 1.5 |
| Example 68 | 3 | 0.8 | 0.1 | 0.5 | 0.1 | Cr 0.04 | 0.026 | $2 \times 10^{10}$ | 0.150 | $4 \times 10^{5}$ | 12 | 805 | 36 | 0.75 | 0.5 |
| Example 69 | 3.5 | 0.9 | | | | | 0.014 | $6 \times 10^{10}$ | 0.230 | $3 \times 10^{5}$ | 18 | 839 | 34 | 0.75 | 0.75 |
| Example 70 | 4 | 1.1 | | | | | 0.024 | $9 \times 10^{10}$ | 0.190 | $4 \times 10^{5}$ | 13 | 855 | 32 | 1 | 1 |
| Example 71 | 4.5 | 1.3 | | | | | 0.027 | $1 \times 10^{11}$ | 0.340 | $4 \times 10^{5}$ | 18 | 888 | 30 | 1.5 | 1.5 |
| Example 72 | 3 | 0.8 | 0.1 | 0.5 | 0.1 | Zr 0.2 | 0.026 | $4 \times 10^{10}$ | 0.150 | $9 \times 10^{6}$ | 14 | 810 | 38 | 0.75 | 0.5 |
| Example 73 | 3.5 | 0.9 | | | | | 0.028 | $7 \times 10^{10}$ | 0.280 | $8 \times 10^{6}$ | 10 | 836 | 36 | 0.75 | 0.75 |
| Example 74 | 4 | 1.1 | | | | | 0.018 | $9 \times 10^{10}$ | 0.190 | $1 \times 10^{7}$ | 9 | 856 | 33 | 1 | 1 |
| Example 75 | 4.5 | 1.3 | | | | | 0.025 | $2 \times 10^{11}$ | 0.120 | $7 \times 10^{6}$ | 8 | 891 | 32 | 1.5 | 1.5 |
| Comparative example 47 | 3 | 0.8 | 0.1 | 0.5 | 0.1 | — | 0.022 | $2 \times 10^{10}$ | None | None | 29 | 805 | 37 | 2 | 1.5 |
| Comparative example 48 | 3.5 | 0.9 | | | | — | 0.025 | $5 \times 10^{10}$ | None | None | 30 | 835 | 35 | 2 | 3 |
| Comparative example 49 | 4 | 1.1 | | | | — | 0.023 | $8 \times 10^{10}$ | None | None | 39 | 866 | 33 | 3 | 3 |
| Comparative example 50 | 4.5 | 1.3 | | | | — | 0.029 | $2 \times 10^{11}$ | None | None | 33 | 880 | 30 | 4 | 4 |

Note:
"—" not added casting a copper alloy, which comprises Ni and Si, into an ingot;

reheating the ingot of the copper alloy at a temperature rising rate of 20 to 200 ° C/hr;

hot rolling the reheated ingot of the copper alloy at 850 to 1,050 ° C. for 0.5 to 5 hours;

quenching the hot-rolled copper alloy, after the hot-rolling at a finished temperature of 300 to 700 ° C.;

cold rolling the quenched copper alloy, subjecting the cold-rolled copper alloy to solution treatment, quenching the solution-treated copper alloy, subjecting the quenched copper alloy to aging treatment, and then cold rolling the aged copper alloy, the alloy comprising:

a precipitate X composed of Ni and Si; and a precipitate Y composed of one of (a) Ni and 0% Si;

(b) Si and 0% Ni, or (c) neither Ni nor Si;

wherein the precipitate X has a grain size of 0.001 to 0.1 μm, the precipitate Y has a grain size of 0.01 to 1 μm, and the precipitate Y has a melting point higher than a solution treatment temperature.

2. The method according to claim 1, wherein immediately following said step of quenching the hot-rolled copper alloy, the quenched and hot-rolled copper alloy is subjected to a step of face-milling to remove an oxide layer on the surface thereof.

3. The method according to claim 1, wherein said step of quenching the solution-treated copper alloy is effected by water quenching.

4. The method according to claim 1, wherein throughout said solution treatment step, the precipitate Y remains even at a temperature in the solution treatment at which the precipitate X is made into a solid solution in the matrix, and wherein Y remains while the precipitate X precipitates again at said later aging treatment step.

5. The method according to claim 1, wherein the copper alloy consists essentially of Ni 2 to 5 mass%, Si 0.3 to 1.5 mass%, and B 0.005 to 0.1 mass%, with the balance being Cu and unavoidable impurities, wherein the number of grains of the precipitate X per $mm^2$ is 20 to 2,000 times the number of grains of the precipitate Y per $mm^2$.

6. The method according to claim 5, wherein the number of grains of the precipitate X is $10^8$ to $10^{12}$ per $mm^2$, and the number of grains of the precipitate Y is $10^4$ to $10^8$ per $mm^2$.

7. The method according to claim 1, wherein the copper alloy consists essentially of Ni 2 to 5 mass%, Si 0.3 to 1.5 mass%, B 0.005 to 0.1 mass%, and at least one element selected from the group consisting of Al, As, Hf, Zr, Cr, Ti, C, Fe, P, In, Sb, Mn, Ta, and V in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$, and wherein the number of grains of the precipitate X is $10^8$ to $10^{12}$ per $mm^2$, and the number of grains of the precipitate Y is $10^4$ to $10^8$ per $mm^2$.

8. The method according to claim 7, wherein the precipitate Y is composed of at least one of Mn—P, Ni—B, Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

9. The method according to claim 1, wherein the copper alloy consists essentially of Ni 2 to 5 mass%, Si 0.3 to 1.5 mass%, B 0.005 to 0.1 mass%, at least one element selected from the group consisting of Al, As, Hf, Zr, Cr, Ti, C, Fe, P, In, Sb, Mn, Ta, and V in an amount of 0.005 to 0.5 mass%, and at least one element selected from the group consisting of Sn 0.1 to 1.0 mass%, Zn 0.1 to 1.0 mass%, and Mg 0.05 to 0.5 mass%, with the balance being Cu and unavoidable impurities, wherein the number of grains of the precipitate X per $mm^2$ is 20 to 2,000 times the number of grains of the precipitate Y per $mm^2$, wherein the number of grains of the precipitate X is $10^8$ to $10^{12}$ per $mm^2$, and the number of grains of the precipitate Y is $10^4$ to $10^8$ per $mm^2$, and wherein the precipitate Y is composed of at least one of Mn—P, Ni—B, Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

10. The method according to claim 9, wherein the copper alloy is for use in an electric or electronic machinery or tool.

11. The method according to claim 1, wherein the copper alloy consists essentially of Ni 2 to 5 mass%, Si 0.3 to 1.5 mass%, Mn 0.01 to 0.5 mass%, and P 0.01 to 0.5 mass%, with the balance being Cu and unavoidable impurities, wherein the number of grains of the precipitate X per $mm^2$ is 20 to 2,000 times the number of grains of the precipitate Y per $mm^2$.

12. The method according to claim 11, wherein the number of grains of the precipitate X is $10^8$ to $10^{12}$ per $mm^2$, and the number of grains of the precipitate Y is $10^4$ to $10^8$ per $mm^2$.

13. The method according to claim 1, wherein the copper alloy consists essentially of Ni 2 to 5 mass%, Si 0.3 to 1.5 mass%, Mn 0.01 to 0.5 mass%, P 0.01 to 0.5 mass%, and at least one element selected from the group consisting of Al, As, Hf, Zr, Cr, Ti, C, Fe, P, In, Sb, Mn, Ta, and V in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$, and wherein the number of grains of the precipitate X is $10^8$ to $10^{12}$ per $mm^2$, and the number of grains of the precipitate Y is $10^4$ to $10^8$ per $mm^2$.

14. The method according to claim 13, wherein the precipitate Y is composed of at least one of Mn—P, Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

15. The method according to claim 1, wherein the copper alloy consists essentially of Ni 2 to 5 mass%, Si 0.3 to 1.5 mass%, Mn 0.01 to 0.5 mass%, P 0.01 to 0.5 mass%, at least one element selected from the group consisting of Al, As, Hf, Zr, Cr, Ti, C, Fe, P, In, Sb, Mn, Ta, and V in an amount of 0.005 to 0.5 mass%, and at least one element selected from the group consisting of Sn 0.1 to 1.0 mass%, Zn 0.1 to 1.0 mass%, and Mg 0.05 to 0.5 mass%, with the balance being Cu and unavoidable impurities, wherein the number of grains of the precipitate X per $mm^2$ is 20 to 2,000 times the number of grains of the precipitate Y per $mm^2$, wherein the number of grains of the precipitate Xis $10^8$ to $10^{12}$ per $mm^2$, and the number of grains of the precipitate Y is $10^4$ to $10^8$ per $mm^2$, and wherein the precipitate Y is composed of at least one of Mn—P, Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

16. The method according to claim 15, wherein the copper alloy is for use in an electric or electronic machinery or tool.

17. The method according to claim 1, wherein the copper alloy consists essentially of Ni 2 to 5 mass%, Si 0.3 to 1.5 mass%, B 0.005 to 0.1 mass%, Mn 0.01 to 0.5 mass%, and P 0.01 to 0.5 mass%, with the balance being Cu and unavoidable impurities, wherein the number of grains of the precipitate X per $mm^2$ is 20 to 2,000 times the number of grains of the precipitate Y per $mm^2$.

18. The method according to claim 17, wherein the number of grains of the precipitate Xis $10^8$ to $10^{12}$ per $mm^2$, and the number of grains of the precipitate Y is $10^4$ to $10^8$ per $mm^2$.

19. The method according to claim 1, wherein the copper alloy consists essentially of Ni 2 to 5 mass%, Si 0.3 to 1.5 mass%, B 0.005 to 0.1 mass%, Mn 0.01 to 0.5 mass%, P 0.01 to 0.5 mass%, and at least one element selected from the group consisting of Al, As, Hf, Zr, Cr, Ti, C, Fe, P, In, Sb, Mn, Ta, and V in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$, and wherein the number of grains of the precipitate Xis $10^8$ to $10^{12}$ per $mm^2$, and the number of grains of the precipitate Y is $10^4$ to $10^8$ per $mm^2$.

20. The method according to claim 19, wherein the precipitate Y is composed of at least one of Mn—P, Ni—B, Al—As, Al—Hf, Al—Zr, Al—Cr, Ti—C, Cu—Ti, Cu—Zr, Cr—Si, Fe—P, Fe—Si, Fe—Zr, In—Ni, Mg—Sb, Mn—Si, Ni—Sb, Si—Ta, and V—Zr.

21. The method according to claim 20, wherein the copper alloy is for use in an electric or electronic machinery or tool.

22. The method according to claim 1, wherein the copper alloy consists of Ni 2 to 5 mass%, Si 0.3 to 1.5 mass%, and Cr in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$.

23. The method according to claim 1, wherein the copper alloy consists of Ni 2 to 5 mass%, Si 0.3 to 1.5 mass%, and Sb in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$.

24. The method according to claim 1, wherein the copper alloy consists of Ni 2 to 5 mass%, Si 0.3 to 1.5 mass%, at least one element selected from the group consisting of Al, As, Hf, Zr, Cr, Ti, C, Fe, P, In, Sb, Mn, Ta, and V in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$.

25. The method according to claim 1, wherein the copper alloy consists of Ni 2 to 5 mass%, Si 0.3 to 1.5 mass%, at least one element selected from the group consisting of Sn 0.1 to 1.0 mass%, Zn 0.1 to 1.0 mass%, and Mg 0.05 to 0.5 mass%, at least one element selected from the group consisting of Zr, Cr, and Sb in an amount of 0.005 to 0.5 mass%, with the balance being Cu and unavoidable impurities, wherein the number of grains of the precipitate X per $mm^2$ is 20 to 2,000 times the number of grains of the precipitate Y per $mm^2$.

26. The method according to claim 1, wherein the melting point of the precipitate Y is higher than a temperature at which the Ni—Si compound of the precipitate X is made into a solid solution.

27. The method according to claim 1, wherein said solution treatment is effected at a temperature around 650 ° C. for an Ni amount of 2.0 mass% or more but less than 2.5 mass%, around 800 ° C. for an Ni amount of 2.5 mass% or more but less than 3.0 mass%, around 850 ° C. for an Ni amount of 3.0 mass% or more but less than 3.5 mass%, around 900 ° C. for an Ni amount of 3.5 mass% or more but less than 4.0 mass%, around 950 ° C. for an Ni amount of 4.0 mass% or more but less than 4.5 mass%, and around 980 ° C. for an Ni amount of from 4.5 mass% to 5.0 mass%.

* * * * *